US005207083A

United States Patent [19]

Bongiovanni et al.

[11] Patent Number: 5,207,083

[45] Date of Patent: May 4, 1993

[54] METHOD OF CONTROLLING THE LENGTH OF CORRUGATED FINS

[75] Inventors: Michael F. Bongiovanni, Amherst; Samuel Cicatello, East Amherst, both of N.Y.

[73] Assignee: General Motors Corporation, Detroit, Mich.

[21] Appl. No.: 802,962

[22] Filed: Dec. 6, 1991

[51] Int. Cl.[5] ..... B21D 13/04

[52] U.S. Cl. ..... 72/9; 72/185

[58] Field of Search ..... 72/185, 187, 9, 12; 83/369, 367, 364

[56] References Cited

U.S. PATENT DOCUMENTS

| | | | |
|---|---|---|---|
| 4,507,948 | 4/1985 | Wallis | 72/185 |
| 4,685,318 | 8/1987 | Ueda et al. | 72/185 |
| 4,838,065 | 6/1989 | Wallis | 72/185 |
| 4,953,378 | 9/1990 | Wallis | 72/185 |
| 5,007,270 | 4/1991 | Wallis | 72/187 |

FOREIGN PATENT DOCUMENTS

| | | | |
|---|---|---|---|
| 169126 | 6/1990 | Japan | 72/185 |
| 891189 | 12/1981 | U.S.S.R. | 72/9 |

*Primary Examiner*—Daniel C. Crane
*Attorney, Agent, or Firm*—Ronald L. Phillips

[57] ABSTRACT

A center machine for producing corrugated fins for heat exchangers has servomotor driven pullout rolls for stretching a compressed corrugated strip to desired fin density and normally driven in phase with corrugation forming rolls. A cutoff knife severs parts from the strip and a sensor measures the length of each part. A control determines part length error, calculates servomotor speed adjustment needed to nearly correct the error and causes such a speed adjustment for a short period to alter the phase of the pullout rolls relative to the forming rolls.

3 Claims, 1 Drawing Sheet

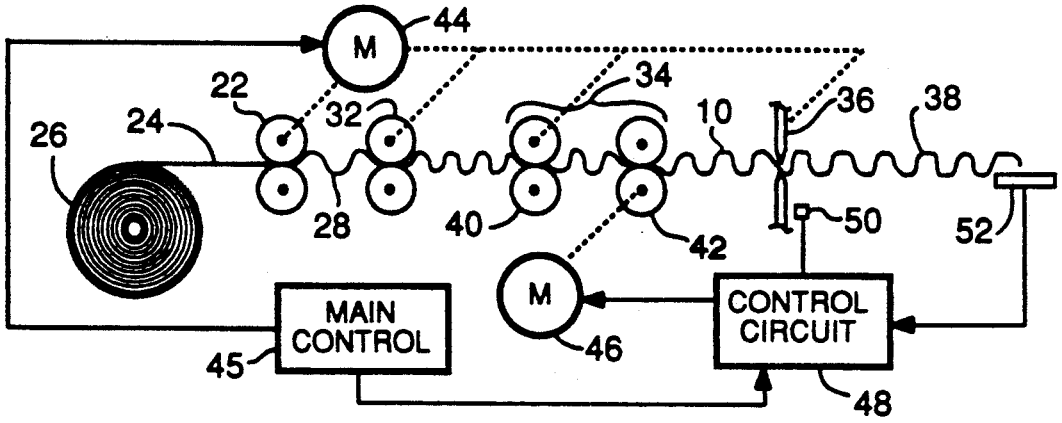
FIG - 1
FIG - 2
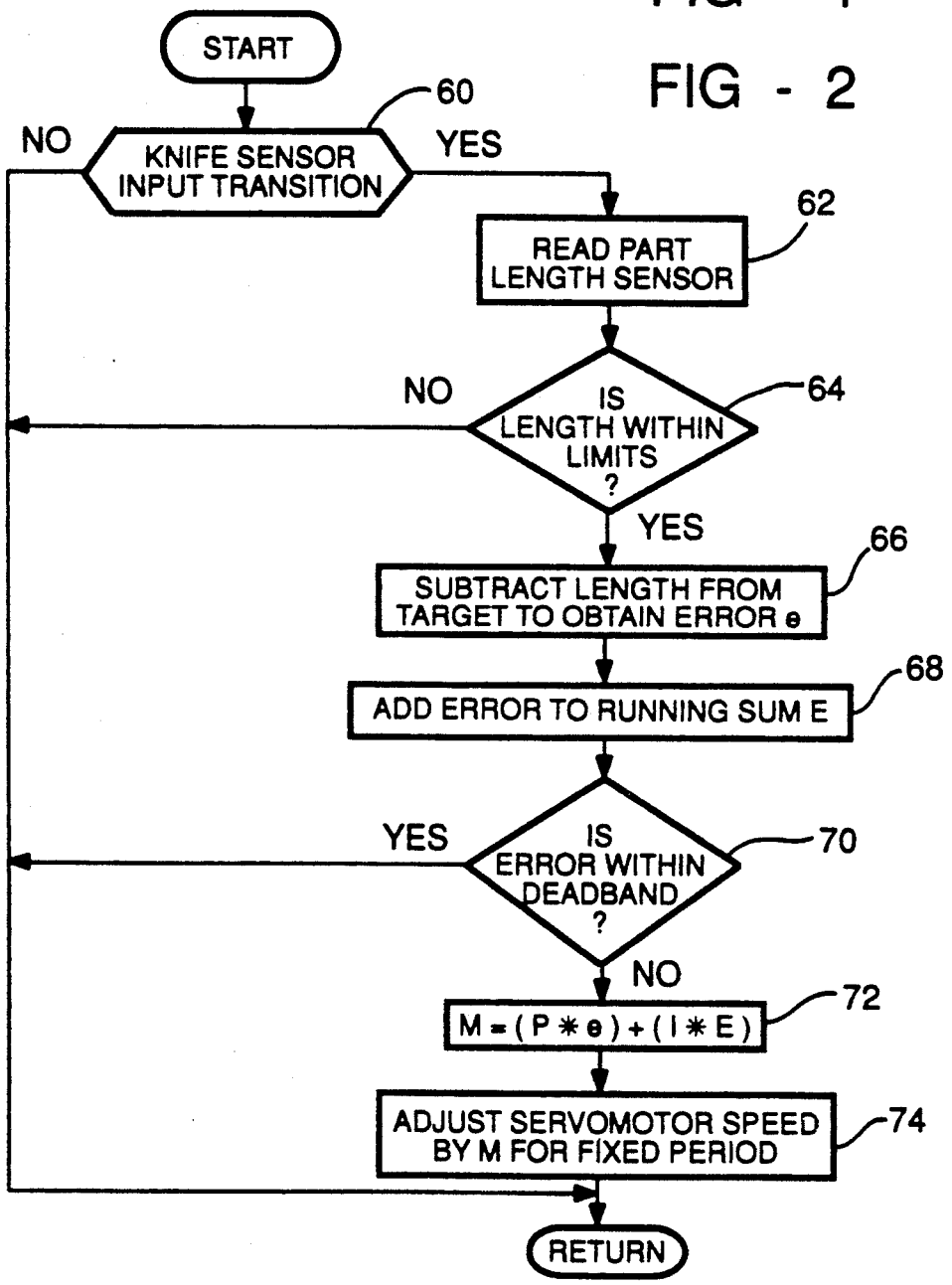

METHOD OF CONTROLLING THE LENGTH OF CORRUGATED FINS

FIELD OF THE INVENTION

This invention relates to the manufacture of heat exchanger fins and particularly to a method of controlling the length of each fin.

BACKGROUND OF THE INVENTION

Automotive radiators and other heat exchangers have a series of parallel flat tubes carrying a hot fluid, such as engine coolant, for transfer of heat to a cooler medium, such as air, which flows around the tubes. To improve heat transfer rate, sinuous or corrugated metal strips called fins or air centers are inserted in the spaces between the flat tubes and soldered or brazed at the junction of the peaks of the air centers and the tubes to assure good heat conductivity from the tubes to the fins. The tubes are assembled in the radiator at fixed spacings and the air centers then must be manufactured to fit in the spacing. Different products may have different heat transfer requirements and thus require centers with different fin spacings or lengths. It is desirable to reliably provide an accurate part length having a preset number of convolutions per part.

It is known to make corrugated fins from sheet stock in a machine with forming rolls for producing a set number of corrugations peaks or convolutions per unit length of strip stock, stuffing rolls to stuff or pack the fins such that the convolutions are touching, then feeding the fins by metering rolls and stretching out the fins by pullout rolls until the desired pitch is obtained. The number of teeth in the pullout rolls and the tooth form determines the nominal fin spacing or density. The corrugated material is stretched between the metering rolls and the pullout rolls during machine set up to achieve substantially the correct fin pitch or density, and to operate the rolls in phase so that the pitch remains the same. The fin is cut into pieces having equal numbers of corrugations so that the part length is then determined by the pitch. It is also known to drive the pullout rolls by a servomotor and to make adjustment of the phase of the pullout rolls through servomotor control to change fin pitch during operation for correction of part length. This is accomplished by detecting whether a cut part is too long or too short and adjusting the phase by a preset increment to make a gross change in the size of the next part without consideration of the amount of deviation of the part length from a target value.

SUMMARY OF THE INVENTION

It is therefore an object of the invention to provide a method of correcting corrugated fin part length in accordance with the amount of deviation of part length from a target value to obtain fine control of the part lengths.

The invention is carried out in a machine for forming corrugated ribbon parts from sheet stock having forming rolls for corrugating the sheet stock, stuffing rolls for compressing the corrugated ribbon to a pitch smaller than the desired product pitch, metering rolls for feeding the compressed ribbon followed by pullout rolls driven by a servo motor for stretching the ribbon out to a desired nominal pitch, and cutter means following the pullout rolls for severing the ribbon into discrete parts; by the method of accurately controlling the part length to a target length comprising the steps of: operating the servomotor to drive the pullout rolls in phase with the metering rolls to maintain the desired nominal pitch; accurately measuring the length of the most recently cut part; comparing the measured part length to the target part length to determine the amount of any error; determining from the error amount the servomotor adjustment required to attain the target part length; and correcting the error for subsequent parts by momentarily changing the servomotor speed according to the said motor adjustment to effect a phase change between the pullout rolls and the metering rolls.

BRIEF DESCRIPTION OF THE DRAWINGS

The above and other advantages of the invention will become more apparent from the following description taken in conjunction with the accompanying drawings wherein like references refer to like parts and wherein:

FIG. 1 is a schematic diagram of a center machine equipped to carry out the method of the invention; and FIG. 2 is a flow chart illustrating the control algorithm for machine control according to the invention.

DESCRIPTION OF THE INVENTION

The air center product to be made herein is well known for use in automotive radiators and is fashioned from thin metal stock, usually aluminum or copper ribbon. The center may be described as corrugated or sinuous in form. Typically, the air center peaks have a height on the order of 9 mm and a pitch of about 4 mm. The apparatus for forming the air center product is also known and is shown in FIG. 1 along with the improvements of this invention. In particular, the known apparatus comprises form rolls 22, resembling meshing gears, which draw strip stock 24 from a supply coil 26 and impart convolutions 28 to the strip to form the sinuous air center 10. At this point the center has the height and pitch which is determined by the rolls 22. After the air center is formed it is compressed by stuff rolls 32 such that the convolutions are touching. The center 10 is withdrawn from the compressed state by a pullout station 34. Finally, a cutoff knife 36 separates the continuous air center strip 10 into individual center lengths or parts 38 having equal numbers of corrugations. In this manner, the apparatus rapidly produces air centers, using stock 24 at a rate of, say, 1000 feet per minute. The pullout station 34 has a pair of metering rolls 40 and a pair of pullout rolls 42 which stretch the center to the desired pitch and then set the pitch into each convolution. The root profile of each tooth of the gear-like rolls 42 is carefully machined to engage the center convolution and cold work the center to give it a permanent set at the correct pitch. To obtain a significantly different pitch a different number of teeth in the rolls is required to provide the correct tooth profile and a different pair of pullout rolls would have to be used. However, for a given set of pullout rolls, an adjustment of pitch on the order of plus or minus 5% or so can be made by changing the amount of stretch of the strip 10 between the metering rolls 40 and the pullout rolls 42. The ensuing description sets forth the manner of adjusting the pitch and the length of the cut part.

A main motor 44 operated by a main control 45 drives the pairs of rolls 22, 32 and 40 through suitable gearing to assure the synchronous rotation of the rolls thereby advancing the strip 10 at the same rate at each station, the rate being measured in terms of roll teeth or corrugations per second. The knife 36 is also driven in synchronism with the rolls, being adjustable to cut a part 38 from the strip each time a preset number of convolutions have been advanced. The pullout rolls 42 are also generally rotated at a rate which coincides with the other rolls but are driven separately by a servomotor 46 which is under control of a control circuit 48, thereby affording the flexibility of easily changing speed when the pullout roll 42 is changed to one having a different number of teeth. To maintain synchronism between the pullout roll and the other rolls the servomotor 46 is electronically lineshafted to the motor 44 by virtue of synchronizing signals delivered from the main control 45 to the control circuit 48.

To accurately measure the length of each part 38 as it is cut from the strip 10 two sensors are employed, both connected to the control circuit 48. A knife sensor 50 detects when the knife 36 is actuated to make a cut and a length sensor 52 determines the part length when the cut is made. The length sensor comprises a high density linear array of photosensors which can determine with high resolution the position of the end of the part 38 at a given time. The center of the length sensor 52 is positioned at a distance from the knife 36 equal to the target part length. When the knife 36 is actuated to sever the part 38, the knife sensor 50 issues a signal to the control which reads the sensor 52 output, thereby obtaining an accurate measurement of the part 38 as it is being cut.

The control circuit 48 is programmed to increase or decrease the servomotor 46 speed for a fixed period if the measured part 38 is too long or too short. The fixed period is empirically determined for a given part length and may be on the order of one half or one second, for example. The amount of servomotor 46 speed change is determined as that which would nearly correct the error in the next part which is produced. A 75% correction, for example will remove most of the error without danger of overshoot to cause an opposite error. Thus the error amount "e" is multiplied by a proportional gain "P" which is sufficient to cause such a correction. It is also desirable to take into account the long term tendency of the machine to produce parts that are either too long or too short. For this purpose the error amount is added to the sum of all the errors on previous parts to obtain a running sum "E". If the part lengths float around the target value, the running sum will be very near zero. The running sum "E" is multiplied by an integral gain "I" to obtain a term which tends to slowly correct the long term error. The two products are added to obtain the motor speed adjustment "M". Thus, $M=(P*e)+(I*E)$. This algorithm is used by the control circuit to change the servomotor speed for the fixed period. Then the pullout rolls will be changed in phase relative to the metering roll to alter the length and fin pitch for the next part and all subsequent parts until another adjustment is made.

The control circuit 48 is a microprocessor based controller. FIG. 2 is a flow chart representing the control algorithm. In every control loop of the microprocessor operation, while the machine is running, the control monitors the input from the knife sensor 50 in step 60. When this input makes a low to high transition, the algorithm samples the part length from the length sensor 52 in step 62. The part length is compared in step 64 to limits of expected part lengths to test the degree of error in the part length. If the part length is out of the limits it is considered to be an erroneous signal and is ignored. Otherwise, in step 66, the sampled part length is then subtracted from the target length which is preset into the control to obtain the error amount as well as the sense of the error (long or short). In step 68, the error value is added to the running sum of errors. The error value is then compared in step 70 to a deadband of approximately plus or minus 0.075 inch. If the error falls within these limits, the part length is considered to be satisfactory. If the error is outside of these limits the above equation is calculated in step 72 to obtain the motor speed adjustment M and the adjustment is carried out in step 74 by suitably controlling the servomotor speed. The measurement and control are repeated for each part.

It will thus be seen that by the method of this invention, a high speed center machine can be adjusted during operation to maintain parts of accurate length by modifying fin density while keeping a constant number of corrugations per part.

The embodiments of the invention in which an exclusive property or privilege is claimed are defined as follows:

1. A method of using a machine for forming corrugated ribbon parts from sheet stock, said machine having forming rolls for corrugating the sheet stock, stuffing rolls for compressing the corrugated ribbon to a pitch smaller than the desired product pitch, metering rolls for feeding the compressed ribbon followed by pullout rolls driven by a servomotor for stretching the ribbon out to a desired nominal pitch, and cutter means following the pullout rolls for severing the ribbon into discrete parts; the method of accurately controlling the part length to a target length comprising the steps of:

operating the servomotor to drive the pullout rolls in phase with the metering rolls to maintain the desired nominal pitch;

measuring with high resolution the length of the most recently cut part;

comparing the measured part length to the target part length to determine the amount of any error;

determining from the error amount of the servomotor adjustment required to attain the target part length by multiplying the amount of error by a proportional gain constant to create a servomotor adjustment that is at least in part proportional to the error amount and which can correct said error without overshoot to create an opposite error; and correcting the error for subsequent parts by momentarily changing the servomotor speed according to the said motor adjustment to effect a phase change between the pullout rolls and the metering rolls.

2. The invention as defined in claim 1 wherein the step of determining the servomotor adjustment includes:

multiplying the error amount by a proportional gain constant to obtain a first term;

adding the error amount to a running sum of previous part lengths to update the running sum, and multiplying the updated running sum by an integral gain constant to obtain a second term; and summing the first and second terms to obtain the servomotor adjustment.

3. The invention as defined in claim 1 wherein the step of correcting the error comprises changing the servomotor speed for an empirically determined time period wherein the amount and sense of speed change is a function of the error amount and the sense of the error.

* * * * *